US009812088B2

(12) United States Patent
Ahn et al.

(10) Patent No.: US 9,812,088 B2
(45) Date of Patent: Nov. 7, 2017

(54) DISPLAY DEVICE INCLUDING GRAY SCALE CORRECTOR AND DRIVING METHOD THEREOF

(71) Applicant: SAMSUNG DISPLAY CO., LTD., Yongin, Gyeonggi-Do (KR)

(72) Inventors: Ik Hyun Ahn, Yongin (KR); Yoon Gu Kim, Yongin (KR); Bong Im Park, Yongin (KR); Seon Ki Kim, Yongin (KR); Ah Young Son, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 324 days.

(21) Appl. No.: 14/103,035

(22) Filed: Dec. 11, 2013

(65) Prior Publication Data

US 2015/0035866 A1 Feb. 5, 2015

(30) Foreign Application Priority Data

Aug. 2, 2013 (KR) ..... 10-2013-0092058

(51) Int. Cl.
*G09G 5/10* (2006.01)
*G09G 3/36* (2006.01)

(52) U.S. Cl.
CPC ..... *G09G 5/10* (2013.01); *G09G 3/3648* (2013.01); *G09G 2300/0426* (2013.01); *G09G 2310/0205* (2013.01); *G09G 2310/0251* (2013.01); *G09G 2320/0233* (2013.01); *G09G 2320/0238* (2013.01); *G09G 2320/0252* (2013.01); *G09G 2320/0271* (2013.01)

(58) Field of Classification Search
CPC ..... G09G 5/10; G09G 3/3648; G09G 2300/0426; G09G 2310/0205; G09G 2320/0271; G09G 2320/0233; G09G 2320/0238; G09G 2320/0252; G09G 2310/0251
See application file for complete search history.

(56) References Cited

U.S. PATENT DOCUMENTS 7,385,576 B2 6/2008 Moon
7,755,681 B2 * 7/2010 Lee ..... H04N 5/202 348/222.1

(Continued)

FOREIGN PATENT DOCUMENTS

CN 100443960 C 12/2008
CN 101394570 A 3/2009

(Continued)

OTHER PUBLICATIONS

European Search Report dated Feb. 4, 2015.

*Primary Examiner* — Kwang-Su Yang
(74) *Attorney, Agent, or Firm* — Lee & Morse, P.C.

(57) ABSTRACT

A display device includes a signal controller and a data driver. The signal controller processes an input image signal to generate an output image signal. The signal controller processes the input image signal using a correction unit. The correction unit corrects the input image signal to a first gray scale value greater than 0 gray scale value when the gray scale value of the input image signal is 0. The output image signal is based on the corrected input image signal. The data driver converts the output image signal into a data voltage to be applied to a display panel.

16 Claims, 11 Drawing Sheets

(56) References Cited

U.S. PATENT DOCUMENTS

| | | | | |
|---|---|---|---|---|
| 8,022,908 | B2 | 9/2011 | Mizukoshi et al. | |
| 9,251,749 | B2 * | 2/2016 | Maruyama | G09G 3/3648 |
| 2008/0186258 | A1 | 8/2008 | Ishimoto et al. | |
| 2011/0012887 | A1 | 1/2011 | Lee et al. | |
| 2011/0205439 | A1 * | 8/2011 | Iisaka | G09G 3/2096 348/607 |
| 2011/0242140 | A1 * | 10/2011 | Lee | G09G 3/3648 345/690 |
| 2011/0279493 | A1 * | 11/2011 | Phan | H04N 9/30 345/694 |
| 2012/0026206 | A1 | 2/2012 | Moon et al. | |
| 2012/0127153 | A1 | 5/2012 | Yukawa | |
| 2012/0229524 | A1 | 9/2012 | Toshima et al. | |
| 2012/0249620 | A1 | 10/2012 | Choi et al. | |

FOREIGN PATENT DOCUMENTS

| | | | |
|---|---|---|---|
| EP | 1 492 078 | A2 | 12/2004 |
| EP | 1492078 | A2 | 12/2004 |
| JP | 2012-037772 | A | 2/2012 |
| KR | 10-2007-0030344 | A | 3/2007 |
| KR | 10-0777705 | B1 | 11/2007 |
| KR | 10-2010-0033893 | A | 3/2010 |
| KR | 10-2015-0010844 | | 1/2015 |
| WO | WO 2007/031915 | A2 | 3/2007 |

* cited by examiner

DISPLAY DEVICE INCLUDING GRAY SCALE CORRECTOR AND DRIVING METHOD THEREOF

CROSS-REFERENCE TO RELATED APPLICATION

Korean Patent Application No. 10-2013-0092058, filed on Aug. 2, 2013, is incorporated by reference herein in its entirety.

BACKGROUND

1. Field

One or more embodiments described herein relate to a display device.

2. Description of the Related Art

Various display devices have been developed. Many of these display devices include a display panel containing a plurality of pixels and signal lines and a plurality of drivers for driving the display panel. Each pixel may include a switching element connected to a respective signal line, a pixel electrode connected to a respective switching element, and an opposing electrode. The drivers include a gate driver for supplying a gate signal to the display panel, a data driver for supplying a data signal to the display panel, a signal controller for controlling the data driver and the gate driver. Examples of display devices of this type include a liquid crystal display (LCD) and an organic light emitting diode (OLED) display.

The pixel electrode may be connected to the switching element, such as a thin film transistor (TFT), to receive a data voltage. The opposing electrode may be formed on the entire surface of the display panel to receive a common voltage Vcom. The pixel electrode and the opposing electrode may be positioned on the same substrate or on different substrates.

For example, a liquid crystal display may include two display panels which include the pixel electrode and the opposing electrode, and a liquid crystal layer having dielectric anisotropy interposed therebetween. The pixel electrodes may be arranged in a matrix and connected to the switching elements to sequentially receive data voltages for each row of the matrix. The opposing electrode may be formed on the entire surface of the display panel to receive a common voltage Vcom. A desired image may be acquired by applying voltages to the pixel electrode and the opposing electrode. These voltages generate an electric field in the liquid crystal layer. The intensity of the electric field may control transmittance of light passing through the liquid crystal layer.

One type of display device may receive an input image signal from an external graphic controller. The input image signal may include luminance information of each pixel, and each luminance may have a predetermined number. Also, each pixel may receive a data voltage corresponding to desired luminance information. The data voltage applied to each pixel is represented as a pixel voltage based on a difference from the common voltage applied to the common electrode. Each pixel displays luminance expressed by a gray scale value of the image signal according to the pixel voltage. In the case of the liquid crystal display, deterioration generated by applying the electric field in one direction to the liquid crystal layer for a long time may be prevented by inverting the polarity of the data voltage for each frame, for each row, for each column, or for each pixel.

Recently, the resolution of display devices has been increased to produce higher quality images. However, as resolution increases, the charging time of each pixel at the data voltage decreases. Especially in the case where the polarity of the data voltage is inverted, the time taken to charge the data voltage to a target data voltage may be insufficient.

Attempts have been made to compensate for charging time under these circumstances. One attempt involves employing a pre-charge driving method. This method involves transferring a pre-charge voltage before the target data voltage is applied to each pixel, in order to rapidly reach a pixel voltage for representing target luminance when the corresponding pixel is main-charged.

SUMMARY

In accordance with one embodiment, a display device includes a display panel including a plurality of pixels; a signal controller to process an input image signal to generate an output image signal; and a data driver to convert the output image signal into a data voltage to be applied to the display panel, wherein the signal controller includes a correction unit to correct the input image signal to a first gray scale value greater than 0 gray scale value when the gray scale value of the input image signal is 0, the output image signal based on the corrected input image signal.

Also, the data driver converts the output image signal into a first black data voltage as a pixel voltage when the gray scale value of the input image signal is 0, and a second black data voltage which is smaller than or equal to a threshold voltage at which pixel luminance starts to change. The first black data voltage is less than the second black data voltage, and the second black data corresponds to a pixel voltage for the first gray scale value. The threshold voltage may be approximately 1.45 V.

Also, the signal controller includes a correction avoidance determining unit to determine whether gray scale vales of input image signals for the plurality of pixels included in one dot are all 0.

Also, the correction avoidance determining unit is to receive the corrected input image signal and the input image signal, and output the input image signals for the one dot as the output image signal when the gray scale values of the input image signals for the plurality of pixels included in the one dot are all 0.

Also, the correction unit includes a lookup table, the lookup table including correction data corresponding to the input image signals, and the first gray scale value is included in the lookup table.

Also, a first pixel among the plurality of pixels is pre-charged by a data voltage for a second pixel which is positioned in a different row from the first pixel, the second pixel connected to a same data line as the first pixel.

Also, the signal controller includes a register to delay the input image signal for a predetermined time, and the correction avoidance determining unit is to receive the input image signal from the register.

Also, the display panel includes a first gate line to transfer a first gate signal, a second gate line to transfer a second gate signal including a gate-on voltage period which overlaps a gate-on voltage period of the first gate signal, a data line crossing the first and second gate lines, a first pixel connected to the first gate line and the data line through a first switch, and a second pixel connected to the second gate line and the data line through a second switch.

Also, the plurality of pixels are positioned in a same pixel column and are alternately connected to different data lines. The first pixel and the second pixel are positioned in different pixel columns.

Also, a plurality of pairs of gate lines may be disposed in corresponding pixel rows, a plurality of pixels positioned in one pixel row are connected to a corresponding one of the pairs of gate lines, and a pair of adjacent pixels connected to a same data line and different gate lines. The first pixel and the second pixel are positioned in a same pixel row.

In accordance with another embodiment, a method for driving of a display device includes processing an input image signal to generate an output image signal; and converting the output image signal into a data voltage, wherein processing the input image signal includes correcting the input image signal to a first gray scale value greater than 0 gray scale value when the gray scale value of the input image signal is 0, the output image signal based on the corrected input image signal.

Also, the converting includes converting the output image signal into a first black data voltage as a pixel voltage when the gray scale value of the input image signal is 0, and converting the output image signal into a second black data voltage which is smaller than or equal to a threshold voltage at which luminance of a pixel starts to change, wherein the first black data voltage is less than a second black data voltage, and wherein the second black data corresponds to a pixel voltage for the first gray scale value. The threshold voltage may be approximately 1.45 V.

Also, the processing includes receiving the corrected input image signal and the input image signal, determining whether gray scale values of the input image signals for a plurality of pixels included in one dot are all 0, and outputting the input image signals for the one dot as the output image signals when the gray scale values of the input image signals for the plurality of pixels included in the one dot are all 0.

Also, processing the input image signal includes delaying the input image signal for a predetermined time.

Also, processing the input image signal includes receiving the corrected image signal and the input image signal, determining whether gray scale values of the input image signals for a plurality of pixels included in one dot are all 0, and outputting the input image signals for the one dot as the output image signals when the gray scale values of the input image signals for the plurality of pixels included in the one dot are all 0. Processing of the input image signal includes delaying the input image signal for a predetermined time.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
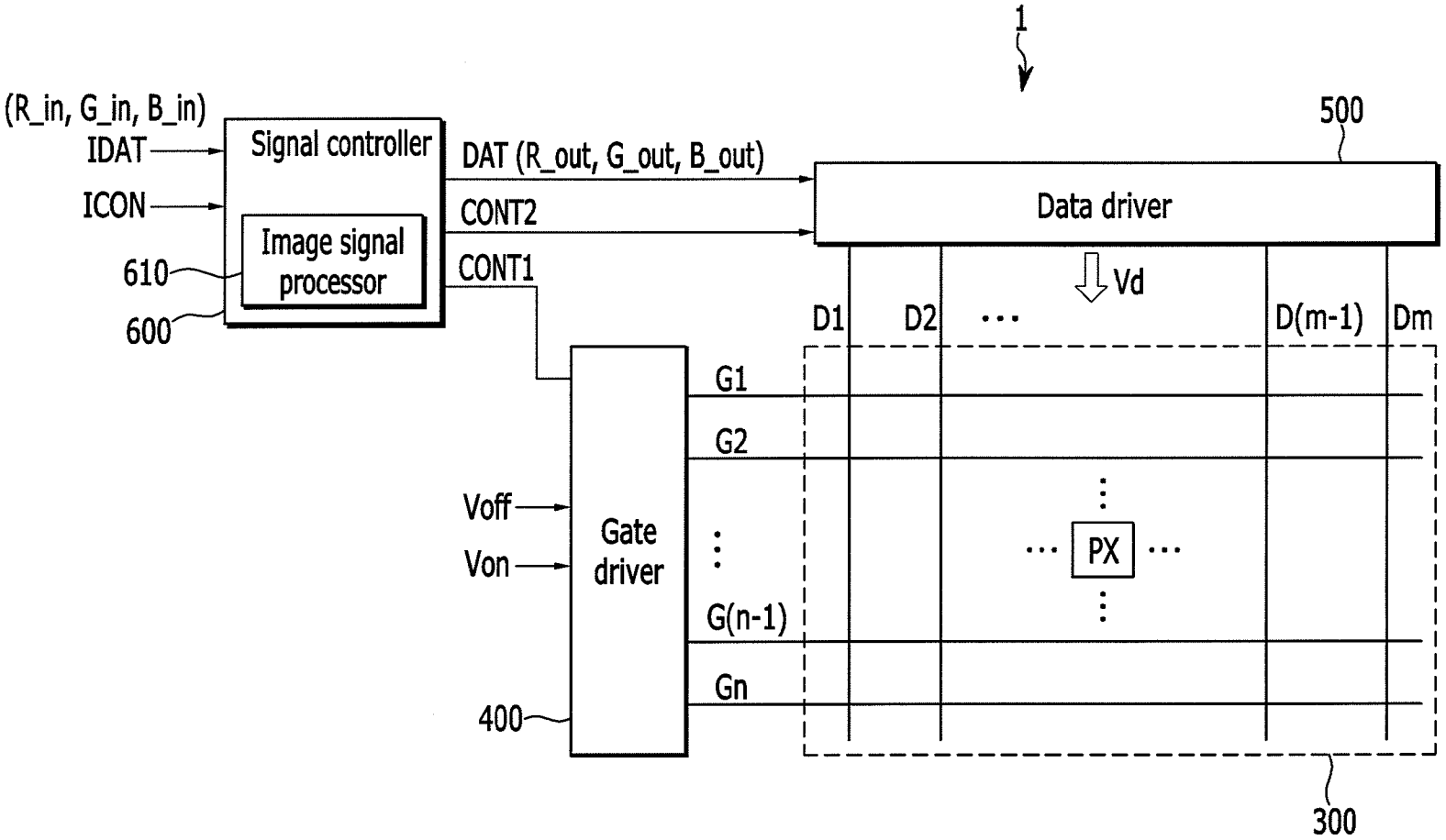
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer substrate, or intervening layers may also be present. Further, it will be understood that when a layer is referred to as being "under" another layer, it can be directly under, and one or more intervening layers may also be present. In addition, it will also be that when a layer is referred to as being "between" two layers, it can be the only layer between the two layers, or one or more intervening layers may also be present. Like reference numerals refer to like elements throughout.

FIG. 1 illustrates one embodiment of a display device 1 which includes a gate driver 400 and a data driver 500 connected to a display panel 300, and a signal controller 600.

The display panel 300 includes a plurality of signal lines and a plurality of pixels PX connected to the signal lines. The pixels PX and signal lines are arranged substantially in a matrix form, when viewed from an equivalent circuit. In the case where the display device is a liquid crystal display, when viewed in cross-section, the display panel 300 may include lower and upper panels facing each other, with a liquid crystal display interposed between the two panels. In other embodiments, the display panel may be an OLED or another type of display panel.

The signal lines include a plurality of gate lines G1-Gn for transferring gate signals (referred to as "scanning signals") and a plurality of data lines D1-Dm for transferring data voltages.

Each pixel PX may include at least one switching element connected to at least one data line D1, D2, . . . , Dm and at least one gate line G1, G2, . . . , Gn, and at least one pixel electrode connected thereto. The switching element may include at least one thin film transistor, and may be controlled according to a gate signal transferred by the gate line G1, G2, . . . , Gn. The gate signal may control transfer of a data voltage Vd, transferred by a respective one of the data lines D1, D2, . . . , Dm, to a corresponding pixel electrode of the pixel PX.

In order to implement color display, each pixel PX may display one of the primary colors (spatial division) or alternately may display the primary colors with time (temporal division), so that a desired color is recognized by the spatial and temporal sum of the primary colors. An example of the primary colors may include three primary colors such as red, green, and blue, or yellow, cyan, magenta, and the like. The plurality of adjacent pixels PX or non-adjacent pixels PX displaying different primary colors may configure one set (referred to as a dot) together. One dot may display a white image. In the following discussion, for illustrative purposes, an example of three primary colors such as red, green, and blue is taken into consideration. Further, R, G, and B may respectively represent red or a red pixel, green or a green pixel, and blue and a blue pixel, respectively.

The data driver 500 is connected with the data lines D1-Dm, and selects a gray scale voltage based on an output image signal DAT received from the signal controller 600. The data driver 500 applies the selected gray scale voltage to the data lines D1-Dm as a data voltage Vd. The data driver 500 may receive a gray scale voltage generated from a separate gray scale voltage generator. The data driver 500 may receive only a predetermined number of reference gray scale voltages and divide the reference gray scale voltages to generate gray scale voltages for all of the gray scale values.

The gate driver 400 is connected to the gate lines G1-Gn and applies gate signals to the gate lines G1-Gn. The gate signals may be configured, for example, based on a combination of a gate-on voltage Von and a gate-off voltage Voff.

The signal controller 600 receives an input image signal IDAT and an input control signal ICON from a graphic controller and controls operations of the gate driver 400, the data driver 500, and the like.

The graphic controller processes image data received from an external source to generate the input image signal IDAT and then may transmit the input image signal IDAT to the signal controller 600. For example, in order to reduce motion blur, the graphic controller may perform or may not perform frame rate control in which an intermediate frame is inserted between adjacent frames.

The input image signal IDAT stores luminance information of each pixel PX. Luminance may have a predetermined number of gray scale values, for example, 1024 (=210), 256 (=28), or 64 (=26) grays. The input image signal IDAT may be provided for each primary color displayed by the pixel PX. For example, in the case where the pixel PX displays any one of the primary colors of red, green, and blue, the input image signals IDAT may include a red input image signal R_in, a green input image signal G_in, and a blue input image signal B_in.

An example of the input control signal ICON includes a vertical synchronization signal, a horizontal synchronization signal, a main clock signal, a data enable signal, and the like.

The signal controller 600 processes the input image signal IDAT based on the input image signal IDAT and the input control signal ICON to convert the processed input image signal IDAT into an output image signal DAT. The signal controller 600 generates a gate control signal CONT1, a data control signal CONT2, and the like. In the case where the pixel PX displays any one of the primary colors of red, green, and the output image signal DAT may include a red output image signal R_out, a green image signal G_out, and a blue output image signal B_out. The data control signal CONT2 may further include an inversion signal for inverting the polarity of the data voltage Vd for a common voltage Vcom (referred to as a polarity of the data voltage).

The signal controller 600 includes an image signal processor 610 which processes the received input image signal IDAT in accordance with a condition of the display panel 300.

To drive the display panel 300, the signal controller 600 receives an input image signal IDAT and an input control signal ICON for controlling display of the input image signal IDAT. The signal controller 600 processes the input image signal IDAT to convert the processed input image signal IDAT into the output image signal DAT, and generates a gate control signal CONT1, a data control signal CONT2, and the like. The signal controller 600 transmits the gate control signal CONT1 to the gate driver 400, and transmits the data control signal CONT2 and the output image signal DAT to the data driver 500.

The data driver 500 receives output image signals DAT for pixels PX in one row according to the data control signal CONT2 from the signal controller 600, and selects a gray voltage corresponding to each output image signal DAT to convert the output image signal DAT into an analog data voltage Vd. The data driver 500 then applies the converted analog data voltage Vd to the corresponding data lines D1-Dm.

The gate driver 400 applies gate-on voltages Von to the gate lines G1-Gn, according to the gate control signal CONT1 from the signal controller 600, to turn on switching elements connected to the gate lines G1-Gn. The data voltages Vd applied to the data lines D1-Dm are applied to the corresponding pixels PX through the turned-on switching elements to be represented as pixel voltages, which are charging voltages of the pixels PX. When the data voltage Vd is applied to the pixel PX, the pixel PX may display luminance corresponding to the data voltage Vd through various optical conversion elements such as a liquid crystal. For example, in the case of the liquid crystal display, the tilted degree of liquid crystal molecules of the liquid crystal layer is controlled to control polarization of light, thereby displaying luminance corresponding to the gray scale value of the input image signal IDAT.

The process is repeated by setting 1 horizontal period [referred to as "1H", and being the same as one period of a horizontal synchronizing signal Hsync and a data enable signal DE] by a unit. As a result, the gate-on voltages Von are sequentially applied to all the gate lines G1-Gn, and the data voltages are applied to all the pixels PX, thereby displaying image(s) for one frame.

After one frame ends, the next frame starts. A state of an inversion signal in the data control signal CONT2 may be controlled so that a polarity of the data Vd applied to each pixel PX is opposite to a polarity in the previous frame (referred to a frame inversion). The polarities of the data voltages Vd applied to all the pixels PX be inverted every one or more frames during the frame inversion. In one application, polarities of the data voltages Vd flowing through one of the data lines D1-Dm may be periodically changed in one frame according to a characteristic of the inversion signal, polarities of the data voltages Vd applied to the data lines D1-Dm in one pixel row may different from each other.

A more detailed embodiment of a pre-charging method of a display device will now be described with reference to FIGS. 2 and 3, in view of FIG. 1.

Figure 2:
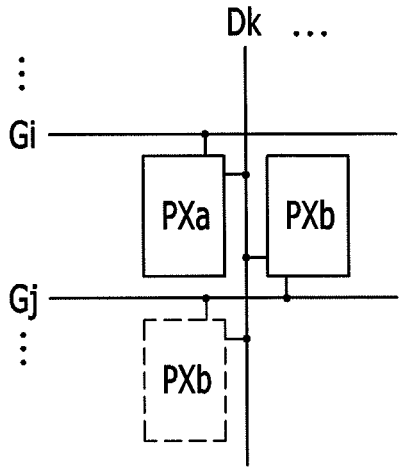
FIG. 2 illustrates a layout of pixels and signal lines of the display device.
Figure 3:
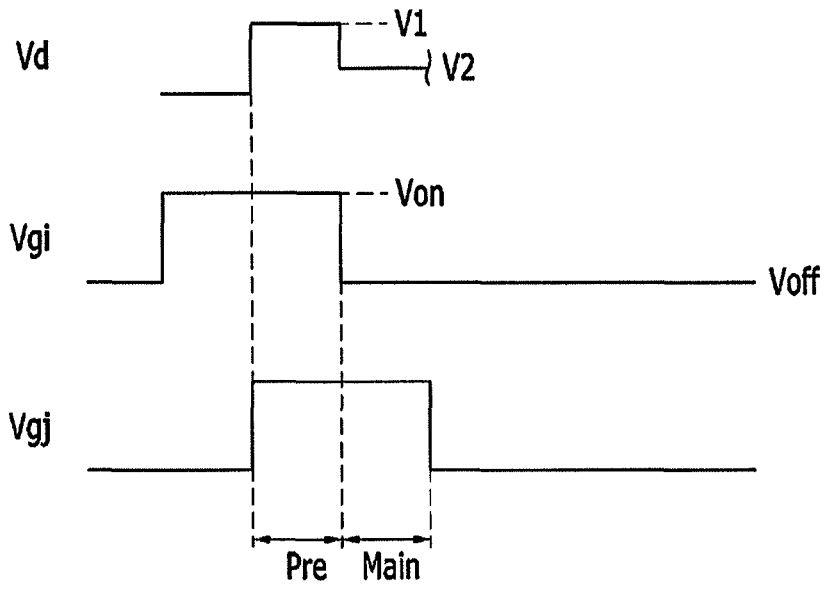
FIG. 3 illustrates a timing diagram of a driving signal of the display device.

FIG. 2 illustrates one embodiment of a layout view of pixels and signal lines of the display device, and FIG. 3 illustrates an example of a timing diagram of a driving signal of the display device.

Referring to FIGS. 2 and 3, the display device includes at least two pixels PXa and PXb connected to different gate lines Gi and Gj (i, j=1, 2, . . . , n) and the same data line Dk (k=1, 2, . . . , m). FIG. 2 illustrates a first pixel PXa connected to a first gate line Gi and data line Dk, and a second pixel PXb connected to a second gate line Gj and data line Dk, as an example. At least two pixels PXa and PXb may be positioned in one pixel row as illustrated by a solid line in FIG. 2, and/or may be positioned in different pixel rows as illustrated by a dotted line in FIG. 2.

Referring to FIG. 3, the first gate line Gi and the second gate line Gj transfer gate signals Vgi and Vgj, respectively. Gate-on voltage Von periods of the gate signals Vgi and Vgj partially overlap. When the first gate line Gi transfers a gate-on voltage Von earlier than the second gate line Gj, a portion of the gate-on voltage Von period of the second gate line Gj that overlaps the gate-on voltage Von period of the first gate line Gi is called a pre-charge period Pre. A portion which does not overlap the gate-on voltage Von period of the first gate line Gi is called a main-charge period Main.

The pre-charge period Pre of the second gate line Gj may correspond to the main-charge period Main of the first gate line Gi. That is, during the pre-charge period Pre of the second gate line Gj, the first pixel PXa connected to the first gate line Gi is charged by a first data voltage V1 corresponding to the output image signal DAT of the first pixel PXa, from among the data voltages Vd transferred by the data line Dk, through a turned-on switching element. In this case, since the gate-on voltage Von is transferred to the switching element connected to the second pixel PXb connected to the second gate line Gj, the second pixel PXb is also pre-charged by the first data voltage V1, which is the same data voltage Vd.

During the main-charge period Main of the second gate line Gj, the data voltage Vd is not transferred to the first pixel PXa. At this time, the second pixel PXb is main-charged by the second data voltage V2 corresponding to the output image signal DAT of the second pixel PXb, among the data voltages Vd, through the turned-on switching element. In one embodiment, the display device may be driven by frame inversion. In the case where the first data voltage Vd and the second data voltage V2 have the same polarity for the common voltage, since the second pixel PXb is pre-charged by the first data voltage V1 having the same polarity as the second data voltage V2 in advance during the pre-charge period Pre, a pixel voltage of the second pixel PXb may rapidly reach a target luminance during the main-charge period Main.

In such a pre-charging method, the second pixel PXb which is a pre-charged object may be referred to as a "pre-charged pixel." The first pixel PXa, which sets the data voltage V1 pre-charged in the second pixel PXb as a main-charge voltage, may be referred to as a "pixel affecting pre-charging.

Gray scale values of a main-charge voltage of the pixel affecting pre-charging may be varied from a minimum gray scale value to a maximum gray scale value according to the input image signal IDAT. Accordingly, since a voltage pre-charged during the pre-charge period Pre of the pre-charged pixel varies according to a gray scale value of the image signal of the pixel affecting pre-charging, a deviation in charging ratio between the pre-charged pixels occurs according to a position of the pixel. As a result, luminance may be differently represented. Particularly, in the case of expressing a predetermined color, an effect due to pre-charging varies according to positions of pre-charged pixels displaying the same primary color. As a result, the luminance varies to be recognized as spots.

For example, when a gray scale value of a pixel affecting pre-charging of one red pixel of two pre-charged red pixels is 0 and a gray scale value of a pixel affecting pre-charging of the other red pixel is a high gray, a difference in the pre-charge degree between the two red pixels occurs, and as a result, a deviation in luminance of the pixels PX of the same primary color may occur. In this case, an image quality defect may occur such as a mixed color horizontal line and a mixed color vertical line. In the case where the display panel 300 has a large area or high resolution, or is driven at a high speed, the charging ratio of each pixel PX may be further decreased. As a result, such an image quality defect may be further increased.

Now, a case where a 0 gray scale value representing black will be discussed.

The image signal processor 610 of the signal controller 600 in the display device may reduce a deviation in the pre-charge degree between the pixels PX displaying the same primary color to prevent such an image quality defect. A detailed structure of the image signal processor 610 and a driving method of the display device including the image signal processor 610 is described with reference to FIGS. 4 to 7.

Figure 4:
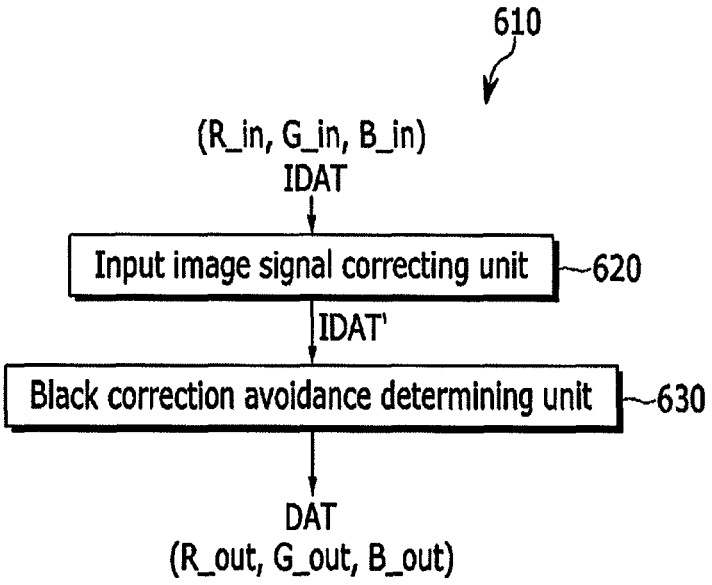
FIG. 4 illustrates one type of an image signal processor of the display device.
Figure 5:
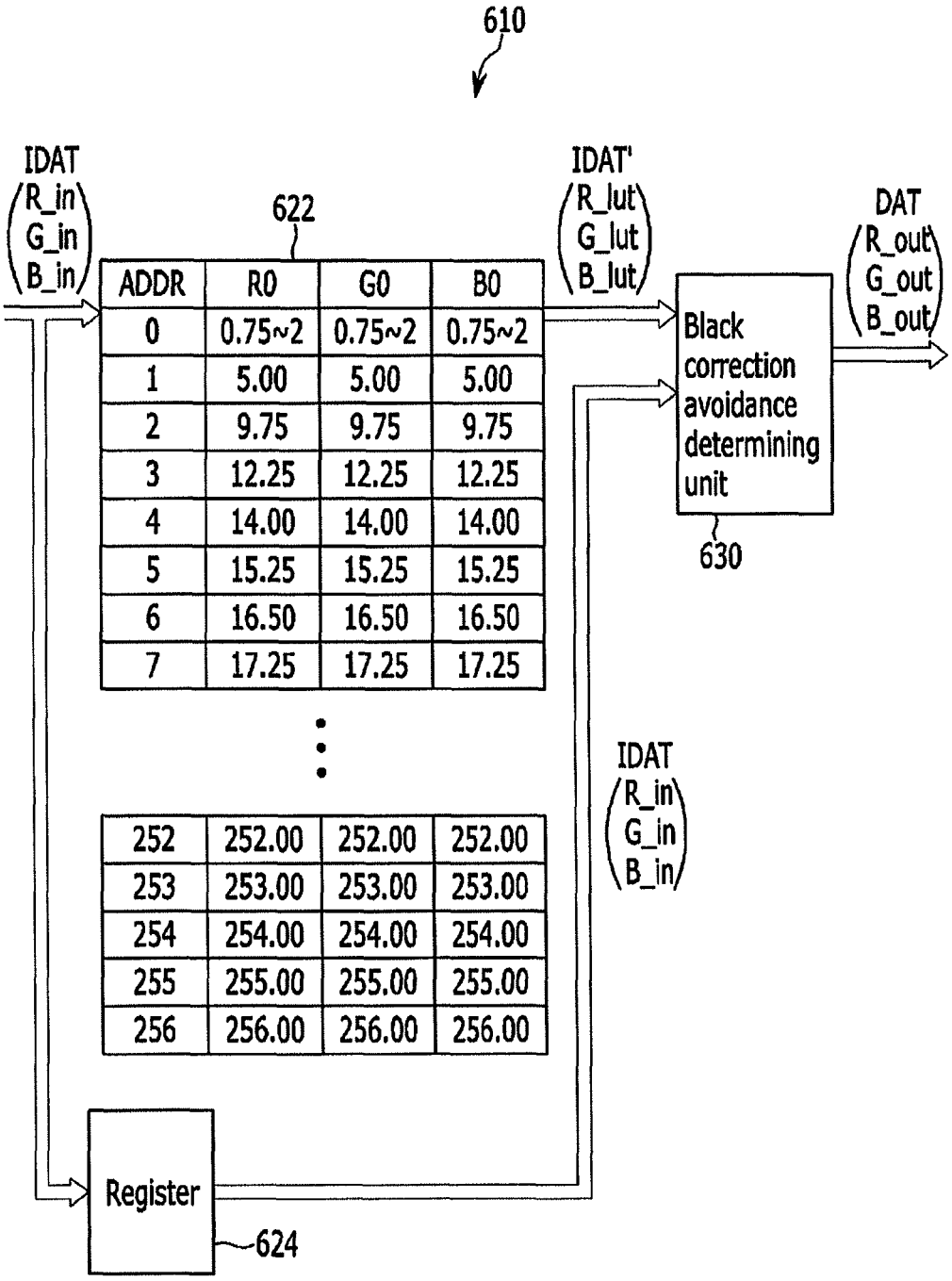
FIG. 5 illustrates a more detailed embodiment of the image signal processor.
Figure 6:
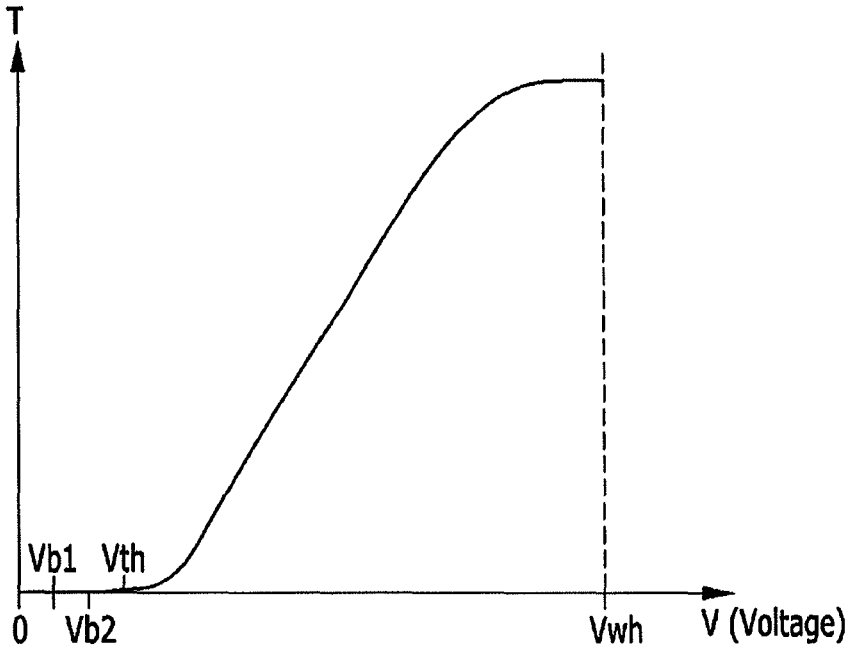
FIG. 6 illustrates a change in transmittance according to pixel voltage.

FIG. 4 illustrates an embodiment of an image signal processor of the display device. FIG. 5 illustrates a more detailed embodiment of an image signal processor of the display device. FIG. 6 is a graph illustrating an example of how transmittance may change according to a pixel voltage of the display device.

First, referring to FIG. 4, the image signal processor 610 of the signal controller 600 includes an input image signal correcting unit 620 and a black correction avoidance determining unit 630. These units may be implemented in software, hardware, or both.

The input image signal correcting unit 620 corrects an input image signal IDAT (R_in, G_in, B_in) in accordance with the display device to generate a correction image signal IDAT'. Examples of the correction includes accurate color capture (ACC) processing or dynamic capacitance compensation (DCC) processing. The number of bits of the correction image signal IDAT' generated by such a correction may be different from the number of bits of the input image signal IDAT before correction. Correction data stored in a separate memory or lookup table may be used during the correction. For example, when the input image signal correcting unit 620 performs the ACC processing, the input image signal correcting unit 620 may convert an N-bit input image signal IDAT into an M-bit correction image signal IDAT' predetermined in accordance with a characteristic of the display device. In this case, the N bits and M bits may be the same as each other, or different from each other. The input image signal correcting unit 620 may include a lookup table for converting the N-bit input image signal IDAT into M-bit correction image signal IDAT'.

FIG. 5 illustrates an example in which the input image signal correcting unit 620 includes a lookup table 622, which may be used to perform the ACC processing. The lookup table 622 stores correction data of respective gray scale values for adjusting luminance for input image signals IDAT of respective primary colors of red, green, and blue in accordance with a target gamma curve. In another type of ACC lookup table which has been proposed, correction data of a 0 gray scale value is stored as it is with respect to the input image signal IDAT of 0 gray.

However, in this embodiment, R, G, and B correction data for many gray scale values of a vertical axis of the lookup table 622 are exemplified, but are not limited to the values shown in the table. More specifically, in lookup table 622, the correction data for the input image signal IDAT of a 0 gray scale value has a value larger than a 0 gray scale value in the aforementioned proposed ACC lookup table. For example, as illustrated in FIG. 5, the correction data for the input image signal IDAT of a 0 gray scale value may be approximately 0.75 to approximately 2.

If an output image signal DAT of a 0 gray scale value is input to the data driver 500 as it is with respect to the input image signal IDAT of 0 gray, the data driver 500 converts the output image signal DAT of the 0 gray scale value into a first black data voltage Vb1, and applies the converted first black data voltage Vb1 to the pixel PX. Here, all data voltages including the first black data voltage Vb1 may correspond to voltages which are based on differences between the common voltage Vcom and respective ones of the data voltages. Further, the data voltage corresponding to the image signal DAT of 0 gray scale value is expressed as the first black data voltage Vb1, but black is exemplified. The first black data voltage Vb1 may be larger than 0V.

FIG. 6 illustrates luminance T of the display device for a pixel voltage V, for example, in the case of a normally black mode liquid crystal display. When a pixel voltage Vwh for a maximum gray is applied, the display device may display maximum luminance. Particularly, the luminance T is substantially 0 up to a certain degree of pixel voltage V around a 0 gray scale value. Accordingly, even though a value of the first black data voltage Vb1 is larger than 0 V, the luminance T may be substantially 0.

The first black data voltage Vb1 may vary according to a characteristic of the display device, for example, a characteristic of a liquid crystal in the liquid crystal display. Also, for example, the first black data voltage Vb1 may be approximately 0.8 V to 1.2 V, but is not limited thereto. The luminance of an image displayed when the first black data voltage Vb1 is applied may be approximately 0.3 nit, but is not limited thereto. Referring back to FIG. 5, the correction data for the input image signal IDAT of 0 gray scale value is larger than a 0 gray scale value. When the correction image signal IDAT' for the input image signal IDAT of a 0 gray scale value is output as the output image signal DAT, the data driver 500 converts the output image signal DAT into a second black data voltage Vb2. The second black data voltage Vb2 is a corrected black data voltage larger than the first black data voltage Vb1. The converted second black voltage Vb2 is applied to the pixel PX.

Referring to FIG. 6, the second black data voltage Vb2 may be equal to or smaller than a threshold voltage Vth at which the luminance corresponding to the first black data voltage Vb1 starts to change. For example, in the case of the liquid crystal display, the second black data voltage Vb2 may be the threshold voltage Vth or less at which the liquid crystal displays black luminance and then starts to move. In the case of the liquid crystal display, the second black data voltage Vb2 may be approximately 1.45 V or less, but is not limited thereto. The second black data voltage Vb2 may vary according to a characteristic of the liquid crystal. When a data voltage larger than the threshold voltage Vth for the input image signal IDAT of a 0 gray scale value is applied to the display panel 300, a contrast ratio may deteriorate.

A difference between luminance in the case of applying the first black data voltage Vb1 to the input image signal IDAT of a 0 gray scale value and luminance in the case of applying the second black data voltage Vb2 may be approximately 0.003 nit or less. Since the difference in the luminance is a level at which people do not recognize, there is no difference in actual luminance of black gray scale values. Accordingly, even though the black data voltage is dualized according to a configuration of 0 gray scale value of the input image signal IDAT for each primary color of the pixels configuring one dot, deterioration of a color coordinate may not occur.

As such, the input image signal IDAT is converted in the lookup table 622 to be output as the correction image signal IDAT'. The correction image signal IDAT' may include a red correction image signal R_lut, a green correction image signal G_lut, a blue correction image signal B_lut.

The image signal processor 610 may further include a register 624, which receives the input image signal IDAT to output the received input image signal IDAT after delaying the received input image signal IDAT for a predetermined time. Here, the delayed predetermined time may correspond to a time for which the input image signal IDAT is processed in the input image signal correcting unit 620. The register 624 may be included in the input image signal correcting unit 620.

Referring to FIGS. 4 and 5, the black correction avoidance determining unit 630 determines whether all of the red input image signal R_in, the green input image signal G_in, and the blue input image signal B_in with respect to one dot are a 0 gray scale value. As a determined result, when the all of the red input image signal R_in, the green input image signal G_in, and the blue input image signal B_in with respect to one dot are a 0 gray scale value, the input image signal IDAT before correction instead of the correction image signal IDAT' is output as the output image signal DAT. In this case, since all of the red, green, and blue input image signals R_in, G_in, and B_in with respect to one dot are a 0 gray scale value, the data driver 500 outputs the first black data voltage Vb1 to all the red, green, and blue pixels R, G, and B.

However, except for the case where the all of the red input image signal R_in, green input image signal G_in, and the blue input image signal B_in are a 0 gray scale value with respect to one dot, the black correction avoidance determining unit 630 outputs a correction image signal IDAT' (R_lut, G_lut, B_lut) received from the input image signal correcting unit 620 as the output image signal DAT. The output image signal DAT may include a red output image signal R_out, a green output image signal G_out, and a blue output image signal B_out. In this case, when any one or two of the green, and blue input image signals R_in, G_in, and B_in with respect to one dot is (are) 0 gray scale value, the data driver 500 outputs the second black data voltage Vb2 larger than the first black data voltage Vb1 with respect to the input image signals R_in, G_in, and B_in of the 0 gray scale value.

Data voltages including the first and second black data voltages Vb1 and Vb2 generated as described above will be described with reference to FIG. 7.

Figure 7:
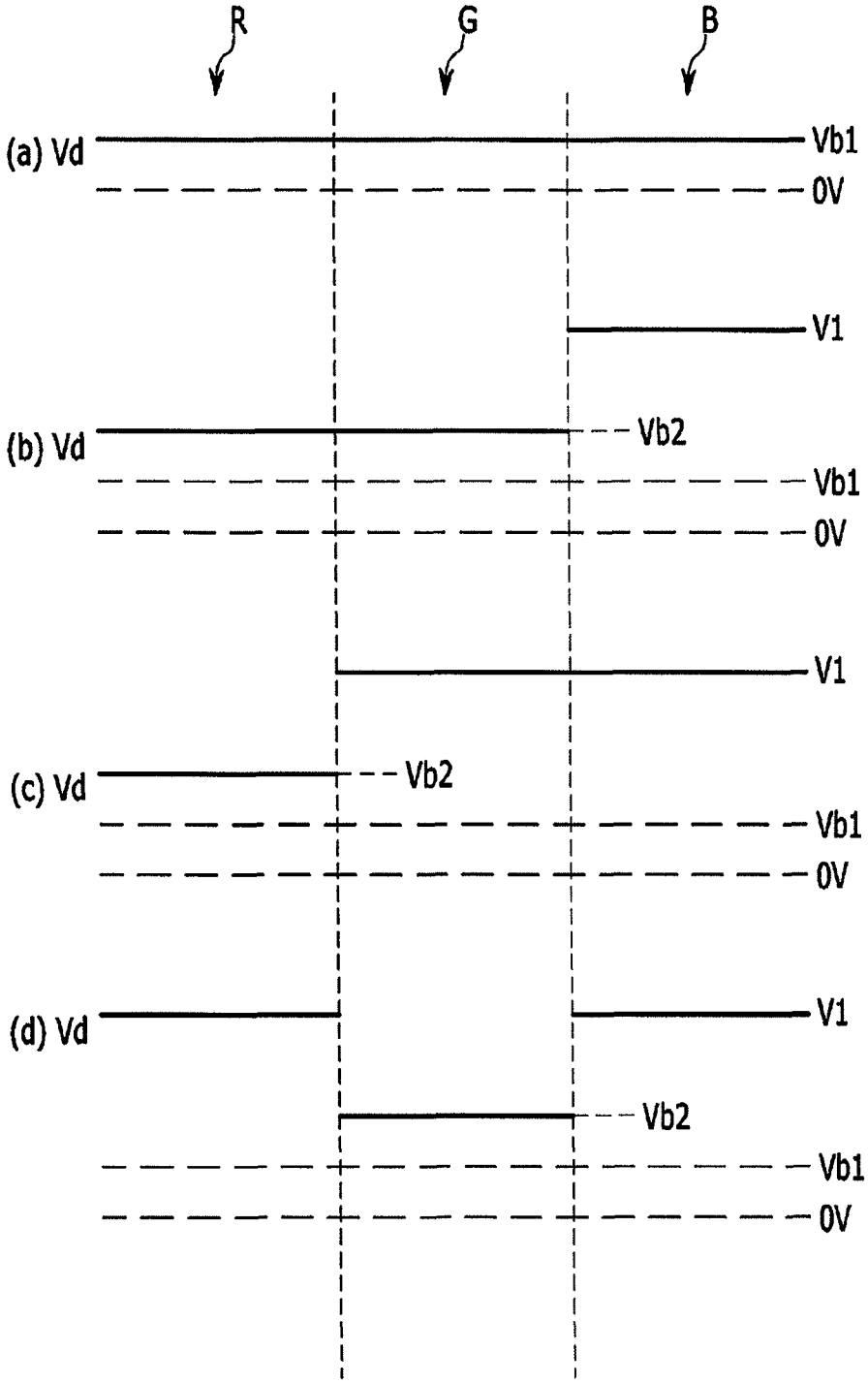
FIG. 7 illustrates a data voltage when a black data voltage is applied to at least some of three primary colored pixels.

FIGS. 7(*a*)-(*d*) illustrates an embodiment of a data voltage when a black data voltage is applied to at least some of three primary colored pixels. In the exemplary embodiment illustrated in FIGS. 7(*a*)-(*d*), an example in which the primary colors displayed by the pixels PX are red R, green G, and blue B is described, but the number and a kind of primary colors are not limited thereto.

As illustrated in FIG. 7(*a*), when all of the red input image signal R_in, the green input image signal G_in, and the blue input image signal B_in with respect to one dot are a 0 gray scale value, the corresponding data voltage Vd may be a first black data voltage Vb1 larger than a common voltage Vcom which is assumed as 0 V.

As illustrated in FIG. 7(*b*), when two of the red input image signal R_in, the input image signal G_in, and the blue input image signal B_in with respect to one dot example, the red input image signal R_in and the green input image signal G_in) are a 0 gray scale value, and the blue input image signal B_in is a gray scale value larger than 0, the data voltage Vd for the red input image signal R_in and the green input image signal G_in is the second black data voltage Vb2 larger than the first black data voltage Vb1. Also, the data voltage Vd for the blue input image signal B_in may be a voltage corresponding to the correction image signal IDAT', for example, the first data voltage V1.

As illustrated in FIG. 7(*c*), when any one of the red input image signal R_in, the green input image signal G_in, and the blue input image signal B_in with respect to one dot (for example, only the red input image signal R_in) is a 0 gray scale value, and the green input image signal G_in and the blue input image signal B_in are gray scale values larger than 0, the data voltage Vd for the red input image signal R_in may be the second black data voltage Vb2 larger than the first black data voltage Vb1. Also, the data voltage Vd for the green input image signal G_in and the blue input image signal B_in may be a voltage corresponding to the correction image signal IDAT', for example, the first data voltage V1.

As illustrated in FIG. 7(*d*), when any one of the red input image signal R_in, the green input image signal G_in, and the blue input image signal B_in with respect to one dot (for example, only the green input image signal G_in) is a 0 gray scale value, and red input image signal R_in and the blue input image signal B_in are gray scale values larger than 0, the data voltage Vd for the green input image signal G_in may be the second black data voltage Vb2 larger than the first black data voltage Vb1. Also, the voltage Vd for the red input image signal R_in and the blue input image signal B_in be a voltage corresponding to the correction image signal IDAT', for example, the first data voltage V1.

As such, according to one or more embodiments, when the input image signals IDAT for all the primary colored pixels of one dot are a 0 gray scale value, the first black data voltage Vb1 is applied to each pixel PX in order to prevent deterioration of the contrast ratio. When the input image signals IDAT for some primary colored pixels of one dot are 0 gray, the second black data voltage Vb2 larger than the first black data voltage Vb1 is applied to the corresponding primary-colored pixels PX. The second black data voltage Vb2 is larger than the first black data voltage Vb1, but may be determined as a magnitude enough not to deteriorate the contrast ratio of the display image or be easily recognized by people.

As a result, even in the case where the input image signal IDAT for the pixel affecting the pre-charged pixel is a 0 gray scale value, the pre-charged black data voltage is increased, and thus the pre-charge degree of the pre-charged pixel may be significantly increased. Accordingly, a deviation in the charging ratio according to a position (different column and different row) of the pixels of the same primary color may be reduced, thereby preventing spots such as horizontal lines or vertical lines from being recognized.

Further, in other proposed methods, in order to prevent an image quality defect of spots such as horizontal lines or vertical lines due to the deviation in the charging ratio, the pre-charging time is reduced. However, according to one or more embodiments, since the pre-charging time may be increased by the reduced deviation in the charging ratio, the charging ratio of the pixel PX may be increased. As a result, the chargeable spots generated when the charging of the pixel PX is insufficient may be reduced.

Figure 8:
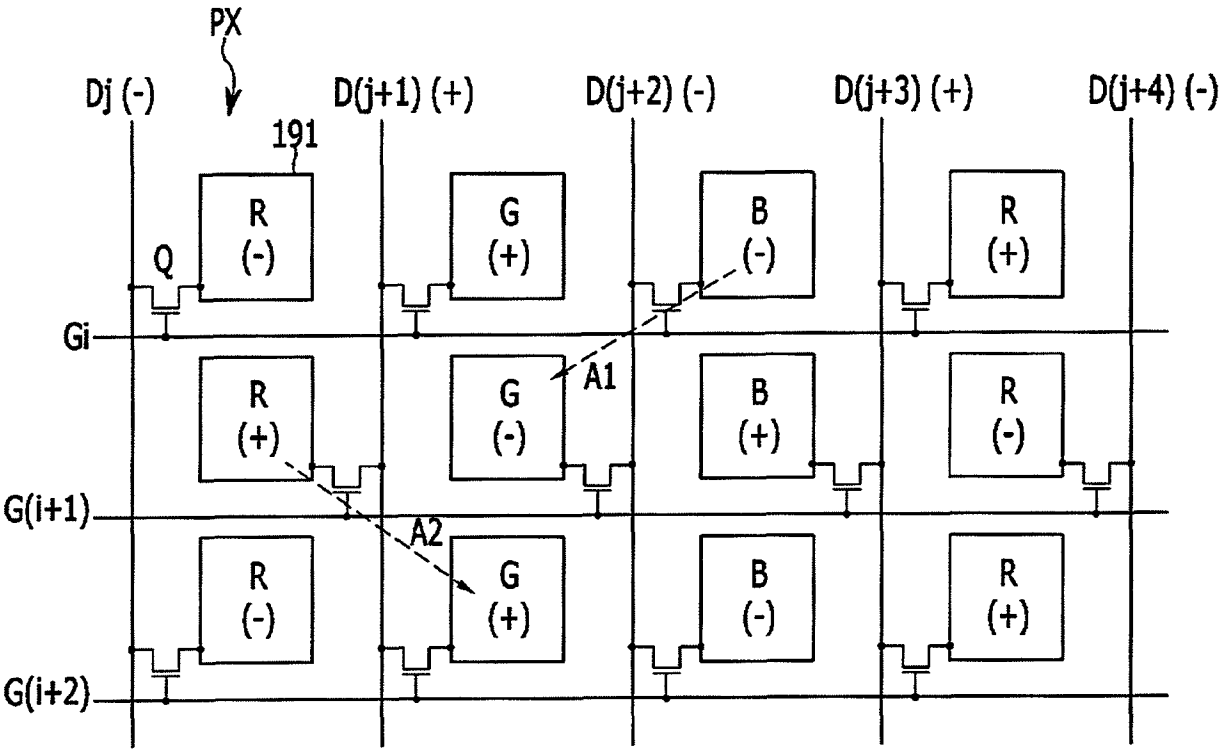
FIG. 8 illustrates another layout of pixels and signal lines of a display device.
Figure 9:
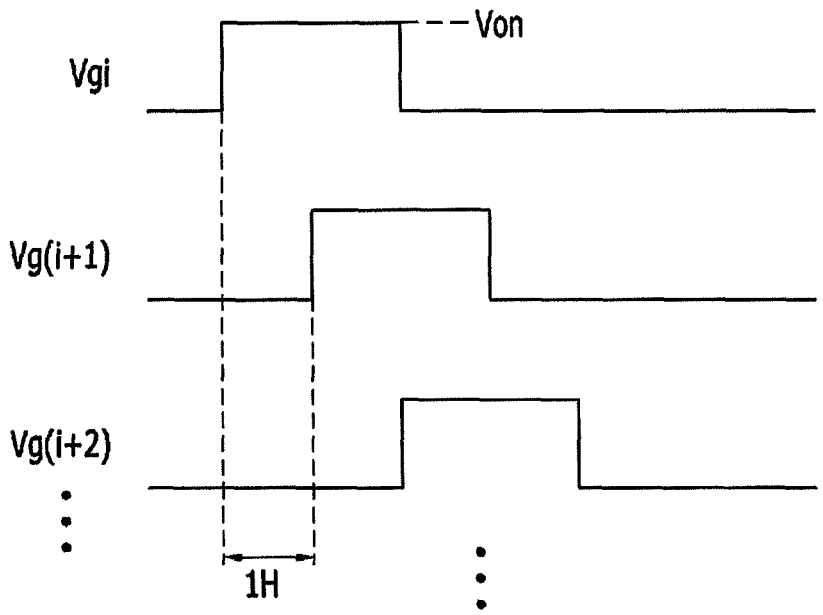
FIG. 9 is a timing diagram of a driving signal of the display device in FIG. 8.

FIG. 8 illustrates a layout of pixels and signal lines in accordance with another embodiment of a display device, and FIG. 9 illustrates an embodiment of a timing diagram of a driving signal for the display device in FIG. 8.

Referring to FIG. 8, the display panel 300 according to this embodiment includes a plurality of gate lines Gi, G(i+1), . . . extending in a row direction, a plurality of data lines Dj, D(j+1), . . . extending in a column direction, and a plurality of pixels PX. Each pixel PX may include a pixel electrode 191 connected to the gate lines Gi, G(i+1), . . . and the data lines Dj, D(j+1), . . . through a switching element Q. Each pixel PX is illustrated to display the primary colors of red R, green G, and blue B, but in other embodiments a different number and/or set of colors may be displayed.

The pixels displaying the same primary colors R, G, and B may be disposed in one pixel column. For example, a pixel column of red pixels R, a pixel column of green pixels G, and a pixel column of blue pixels B may be alternately disposed. One of the data lines Dj, D(j+1), . . . may be disposed for each pixel column, and one of the gate lines Gi, G(i+1), . . . may be disposed for each pixel row, but are not limited thereto.

The pixels R, G, and B disposed in one pixel column to display the same colors may be connected to one of two adjacent data lines Dj, D(j+1), . . . , etc. As illustrated in FIG. 8, the pixels R, G, and B disposed in one pixel column may be alternately connected to two adjacent data lines Dj, D(j+1), . . . The pixels R, G, and B positioned in the same pixel row may be connected to the same gate lines Gi, G(i+1), etc.

Data voltages having opposite polarities may be applied to the adjacent data lines Dj, D(j+1), . . . , etc. The polarity of the data voltage may be inverted for each frame. As a result, the adjacent pixels R, G, and B in the column direction may receive data voltages having opposite polarities. The adjacent pixels R, G, and B in one pixel row may receive the data voltages having opposite polarities to be driven substantially in a 1 ×1 dot inversion form. That is, even though the adjacent pixels R, G, and B are driven in a column inversion in which the data voltages applied to the data lines Dj, D(j+1), . . . maintain the same polarity for one frame, dot inversion driving may be implemented.

Referring to FIG. 9, gate-on voltages Von of gate signals Vgi, Vg(i+1), and Vg(i+2) may be sequentially applied to the gate lines Gi, G(i+1), . . . for 1horizontal period 1H. Periods of the gate-on voltages Von of two of the gate signals Vgi, Vg(i+1), and Vg(i+2) which are sequentially applied partially overlap. The overlap portion of the gate-on voltages Von corresponds to the pre-charged period Pre for which the pixels R, G, and B, to which the gate signals Vgi, Vg(i+1), and Vg(i+2) to be subsequently applied, are pre-charged.

According to the exemplary embodiment in FIGS. 8 and 9, the pixels PX in the pixel row displaying the same primary color are pre-charged by the data voltages applied to the pixels PX that display different colors, based on the data lines Dj, D(j+1), . . . to which the pixels are connected.

For example, in FIG. 8, the green pixel G connected to the gate line G(i+1) and the data line D(j+2) is pre-charged by a data voltage having the same polarity applied during main-charging of the blue pixel B connected to the previous gate line Gi and the same data line D(j+2) as the green pixel G, as indicated by an arrow A1. On the other hand, the green pixel G connected to the gate line G(i+2) and the data line D(j+1) is pre-charged by a data voltage having the same polarity applied during main-charging of the red pixel R connected to the previous gate line G(i+1) and the same data line D(j+1) as the green pixel G, as indicated by an arrow A2.

When uncorrected, the pixels affecting the pre-charging of the two green pixels G positioned in different rows is performed differently from one another. The green pixel G coupled to data line D(J+2) is pre-charged by the blue pixel B, and the green pixel G coupled t the data line D(j+1) is pre-charged by the red pixel R. This occurs when either of the blue pixel B or the red pixel R has a 0 gray scale value and the other one has a gray scale value higher than a 0 gray scale value, a difference in the pre-charge degree of the two green pixels G positioned in different rows and a difference in luminance occurs. As a result, spots may be generated. The spots may be in the form of horizontal lines or other screen marks or artifacts.

However, according to the present embodiment, since the image signal 610 corrects the input image signal of a 0 gray scale to a gray scale value larger than 0 example, approximately 0.75 to 2) for purposes of applying the second black data Vb2 to the corresponding pixel PX, a difference in the pre-charge degree (due to a gray difference between the pixels PX affecting the pre-charging of the same primary pixels positioned in different rows) and a difference in luminance may be reduced. As a result, spots may be prevented from being perceived by a user.

Particularly, in the case where the pixels PX in the same pixel column are alternately connected to the adjacent data lines Dj, D(j+1)), . . . , when the pixels PX in one pixel row displaying the same primary color are affected by the pixels displaying different primary colors with respect to the pre-charging, any one of the pixels displaying different primary colors displays a 0 gray scale value. As a result, generation of mixed color horizontal lines, represented when the image having the predetermined color is displayed, may be reduced.

Figure 10:
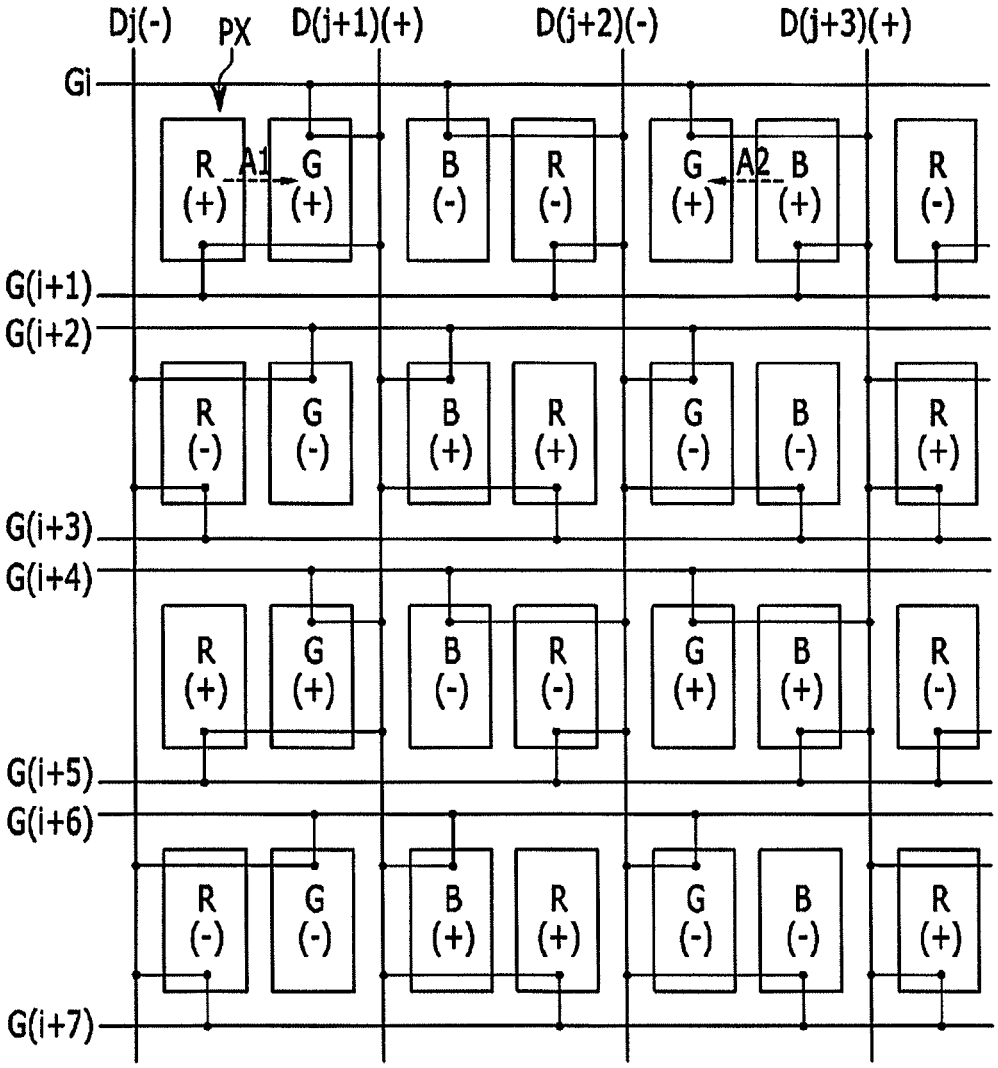
FIG. 10 illustrates another layout of pixels and signal lines of a display device.
Figure 11:
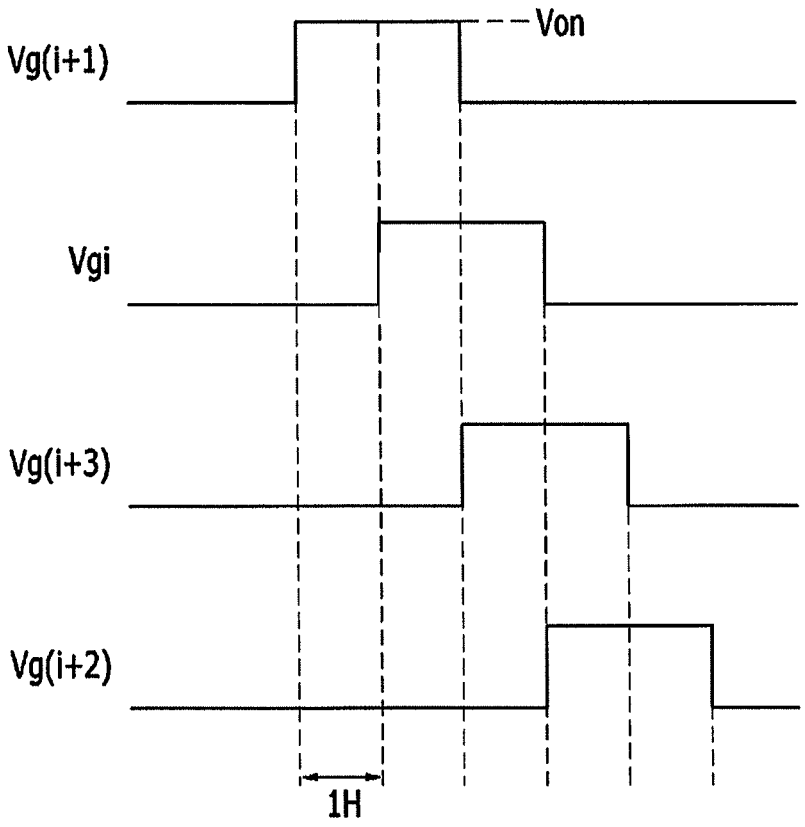
FIG. 11 is a timing diagram of a driving signal of the display device in FIG. 10.

FIG. 10 illustrates a layout of pixels and signal lines in accordance with another embodiment of a display device, and FIG. 11 illustrates an embodiment of a timing diagram of a driving signal of the display device in FIG. 10.

Referring to FIG. 10, the display panel 300 according to this embodiment includes a plurality of gate lines Gi, G(i+1), . . . , G(i+7) extending in a row direction, a plurality of data lines Dj, D(j+1), . . . , D(j+3) extending in a column direction, and a plurality of pixels PX. Each pixel PX may include a pixel electrode connected to the gate lines Gi, G(i+1), . . . , G(i+7) and the data lines Dj, D(j+1), . . . , D(j+3) through a switching element. In this embodiment, each pixel PX is illustrated to display the primary colors of red R, green G, and blue B. As with all embodiments described herein, the pixels may alternatively display different set of numbers and/or a different set of colors. The pixels displaying the same primary color may be disposed in one pixel column. For example, a pixel column of red pixels R, a pixel column of green pixels G, and a pixel column of blue pixels B may be alternately disposed. Two pixels R, G, and may be disposed between two adjacent data lines Dj, D(j+1), . . . , D(j+3), and two of the gate lines Gi, G(i+1), . . . , G(i+7) may be disposed per every pixel row, but they are not limited thereto.

In the case where two gate lines Gi, G(i+1), . . . , G(i+7) are disposed per every pixel row, the pixels R, G, and B in each pixel row may be connected to one of the two corresponding gate lines Gi, G(i+1), . . . , G(i+7).

The pixels R, G, and B disposed in one pixel column may be connected to one of the two adjacent data lines Dj, D(j+1), . . . , D(j+3). More specifically, the pixels R, G, and B disposed in one pixel column may be alternately connected to the two adjacent data lines Dj, D(j+1), . . . , D(j+3).

More particularly, a pair of pixels R, G, and B connected to different gate lines Gi, G(i+1), . . . , G(i+7) in one pixel row may be connected to the same data lines Dj, D(j+1), . . . , D(j+3). Pair of pixels R, G, and B disposed between the two adjacent data lines Dj, D(j+1), . . . , D(j+3) may be connected to two different gate lines Gi, G(i+1), . . . , G(i+7) and the same data lines Dj, D(j+1), . . . , D(j+3).

Data voltages having opposite polarities may be applied to the adjacent data lines Dj, D(j+1), . . . , D(j+3). The polarity of the data voltage may be inverted for each frame. As a result, the adjacent pixels R, G, and B in the column direction may receive the data voltages having opposite polarities, and every two pixels of the R, G, and B pixels in one pixel row may receive the data voltages having opposite polarities, to therefore be driven substantially in a dot inversion form. That is, even though the pixels R, G, and B are driven in a column inversion, in which the data voltages applied the data lines Dj, D(j+1), . . . , D(j+3) maintain the same polarity for one frame, dot inversion driving may be implemented.

Referring to FIG. 11, gate-on voltages Von of gate signals Vgi, Vg(i+1), . . . , Vg(i+2) are sequentially applied for 1 horizontal period 1H. An example in which the gate-on voltages Von may be first applied to the gate lines Gi, G(i+1), . . . , G(i+7) positioned at a lower side among the pair of gate lines Gi, G(i+1), . . . , G(i+7) disposed in one pixel row is described in the exemplary embodiment in FIG. 9, but is not limited thereto.

Periods of two gate-on voltages Von of two gate signals Vgi, Vg(i+1), . . . , Vg(i+2) to which the gate-on voltages Von are temporally sequentially input partially overlap. The front portion of the gate-on voltage Von corresponds to the pre-charged period Pre for which the pixels R, G, and B connected to the corresponding gate lines Gi, G(i+1), . . . , G(i+7) are pre-charged.

According to the exemplary embodiment in FIGS. 10 and 11, even though two pixels PX display the same primary color, they are pre-charged by data voltages applied to the pixels PX displaying different colors, based on the pixel column in which the two pixels PX displaying the same primary color are positioned.

For example, referring to FIG. 10, the green pixel G connected to the gate line and the data line D(j+1) is pre-charged by a data voltage having the same polarity during main-charging of the red pixel R (connected to the gate line G(i+1) receiving the gate-on voltage earlier than the gate line Gi and the same data line D(j+1)), as indicated by an arrow A1. On the other hand, the green pixel G connected to the gate line Gi and data line D(j+3) is pre-charged by a data voltage having the same polarity applied main-charging of the blue pixel B (connected to the gate line G(i+1) and the data line D(j+3)), as indicated by an arrow A2.

Accordingly, when uncorrected, since the pixels affecting the pre-charging of the two green pixels G positioned in different pixel columns are different from each other (e.g., one charged by a red pixel R and the other charged by a blue pixel B), when either of the blue pixel B or the red pixel R represents a 0 gray scale value and the other one represents a gray higher than 0, differences in the pre-charge degree and luminance of the two green pixels G positioned in different pixel columns occur. As a result, spots such as vertical lines, marks, and/or other artifacts may be generated.

However, according to the present embodiment, the image signal processor 610 corrects the input image signal of a 0 gray scale value to a gray scale value larger than 0 (for example, approximately 0.75 to 2). The second black data voltage Vb2 is therefore applied to the corresponding pixel PX. As a result, differences in the pre-charge degree and luminance (due to a gray difference between the pixels PX affecting the pre-charging of the same primary colored pixels positioned in different pixel columns) may be reduced. Spots may therefore be prevented from being perceived by a user.

This approach may be applied in the case where pixels PX displaying the same primary color positioned in different pixel columns are paired with the pixels PX displaying different primary colors connected to the same data line. When the pixels PX in different pixel columns displaying the same primary color are affected by the pixels displaying different primary colors with respect to pre-charging, any one of the pixels displaying different primary colors displays a 0 gray scale value. As a result, generation of mixed color vertical lines (represented when the image having the predetermined is displayed) may be reduced.

By way of summation and review, one or more embodiments described herein provide a display device and a driving method thereof which prevent or reduce the occurrence or perception of spots (such as horizontal lines or vertical lines) from being recognized in an image. This may be accomplished by removing deviation in luminance caused by a difference of a charging ratio, which may vary on a pixel-by-pixel basis, in the display device in which a pre-charge driving method is implemented. Further, one or more embodiments described herein provide a display device and a driving method thereof which prevents or reduces the generation of chargeable spots by improving a charging ratio.

Example embodiments have been disclosed herein, and although specific terms are employed, they are used and are to be interpreted in a generic and descriptive sense only and not for purpose of limitation. In some instances, as would be apparent to one ordinary skill in the art as of the filing of the present application, features, and/or elements described in connection with a particular embodiment may be used singly or in combination with features, characteristics, and/or elements described in connection with other embodiments unless otherwise specifically indicated. Accordingly, it will be understood by those of skill in the art that various changes in and details may be made without departing from the spirit and scope of the present invention as set forth in the following claims.

What is claimed is:

1. A display device, comprising:

a display panel including a plurality of pixels;

a signal controller to process input image signals to generate output image signals; and a data driver to convert the output image signals into data voltages to be applied to the display panel, wherein the signal controller includes:

a corrector to perform gray scale correction when gray scale values of input image signals for one dot are not all 0, the corrector to correct the gray scale values of the input image signals to a gray scale value greater than 0 gray scale value when the gray scale values of the input image signals for the pixels of the one dot are 0, and the output image signals based on the corrected gray scale values of the input image signals, and a correction avoidance determiner to output the input image signals for the pixels of the one dot as output image signals without being corrected by the corrector when the gray scale values of the input image signals for the pixels of the one dot are all 0, wherein the pixels for the one dot are to output different colors of light, and wherein the correction avoidance determiner is to:

receive the corrected gray scale values of the input image signals and the input image signals, and output the input image signals for the one dot as the output image signals when the gray scale values of the input image signals for the pixels of the one dot are all 0.

2. The display device of claim 1, wherein the data driver converts each of the output image signals into:

a first black data voltage as a pixel voltage when a corresponding one of the gray scale values of the input image signals is 0, or a second black data voltage which is smaller than or equal to a threshold voltage at which pixel luminance starts to change, wherein the first black data voltage is less than the second black data voltage, and wherein the second black data corresponds to a pixel voltage for the gray scale value greater than 0 gray scale value.

3. The display device of claim 2, wherein the correction avoidance determiner is to determine whether the gray scale values of the input image signals for the pixels of the one dot are all 0.

4. The display device of claim 2, wherein the threshold voltage is approximately 1.45 V.

5. The display device of claim 1, wherein:

the corrector includes a lookup table, the lookup table including correction data corresponding to the input image signals, and the gray scale value greater than 0 gray scale value is included in the lookup table.

6. The display device of claim 5, wherein:

a first pixel among the pixels is pre-charged by a data voltage for a second pixel which is positioned in a different row from the first pixel, the second pixel connected to a same data line as the first pixel.

7. The display device of claim 1, wherein:

the signal controller includes a register to delay the input image signals for a predetermined time, and the correction avoidance determiner is to receive the input image signals from the register.

8. The display device of claim 7, wherein the display panel includes:

a first gate line to transfer a first gate signal, a second gate line to transfer a second gate signal including a gate-on voltage period which overlaps a gate-on voltage period of the first gate signal, a data line crossing the first and second gate lines, a first pixel connected to the first gate line and the data line through a first switch, and a second pixel connected to the second gate line and the data line through a second switch.

9. The display device of claim 8, wherein:

the pixels are positioned in a same pixel column and are alternately connected to different data lines.

10. The display device of claim 8, wherein the first pixel and the second pixel are positioned in different pixel columns.

11. The display device of claim 8, wherein:

a plurality of pairs of gate lines disposed in corresponding pixel rows, a plurality of pixels positioned in one pixel row are connected to a corresponding one of the pairs of gate lines, and a pair of adjacent pixels connected to a same data line and different gate lines.

12. The display device of claim 8, wherein the first pixel and the second pixel are positioned in a same pixel row.

13. A method for driving of a display device, comprising:

processing input image signals to generate an output image signals; and converting the output image signals into data voltages, wherein processing the input image signals includes:

performing gray scale correction when gray scale values of input image signals for one dot are not all 0, the gray scale correction including correcting gray scale values of the input image signals to a gray scale value greater than 0 gray scale value when the gray scale values of the input image signals for pixels of the one dot are 0, the output image signals based on the corrected gray scale values of the input image signals, and outputting the input image signals for the pixels of the one dot as output image signals without the gray scale correction when the gray scale values of the input image signals for the pixels of the one dot are all 0, wherein the pixels for the one dot are to output different colors of light, and wherein the processing includes:

receiving the corrected gray scale values of the input image signals and the input image signals, determining whether gray scale values of the input image signals for the pixels of the one dot are all 0, and outputting the input image signals for the one dot as the output image signals when the gray scale values of the input image signals for the pixels of the one dot are all 0.

14. The method of claim 13, wherein the converting includes:

converting each of the output image signals into first black data voltage as a pixel voltage when the gray scale values of a corresponding one of the input image signals is 0, or converting each of the output image signals into a second black data voltage which is smaller than or equal to a threshold voltage at which luminance of a pixel starts to change, wherein the first black data voltage is less than the second black data voltage, and wherein the second black data corresponds to a pixel voltage for the gray scale value greater than 0 gray scale value.

15. The method of claim 14, wherein the threshold voltage is approximately 1.45 V.

16. The method of claim 13, wherein processing the input image signals includes delaying the input image signals for a predetermined time.

* * * * *